US007458874B2

(12) United States Patent
Rung et al.

(10) Patent No.: US 7,458,874 B2
(45) Date of Patent: Dec. 2, 2008

(54) ROBOT-LIKE ELECTRONIC DEVICE

(75) Inventors: Bi-Jang Rung, Banciao (TW); Yi-Lung Wu, Tainan (TW); Ching-Yuan Yang, Taipei (TW)

(73) Assignee: Micro-Star Int'l Co., Ltd., Taipei (TW)

( * ) Notice: Subject to any disclaimer, the term of this patent is extended or adjusted under 35 U.S.C. 154(b) by 430 days.

(21) Appl. No.: 11/298,468

(22) Filed: Dec. 12, 2005

(65) Prior Publication Data

US 2006/0135034 A1 Jun. 22, 2006

(30) Foreign Application Priority Data

Dec. 22, 2004 (TW) ..... 93140081 A

(51) Int. Cl.
*A63H 3/00* (2006.01)

(52) U.S. Cl. ..... 446/330; 446/353; 446/376

(58) Field of Classification Search ..... 446/456, 446/175, 376, 330, 73, 99, 298, 487, 470; D21/579, 584, 582
See application file for complete search history.

(56) References Cited

U.S. PATENT DOCUMENTS 4,571,199 A * 2/1986 Murakami ..... 446/73
D286,800 S * 11/1986 Maruyama ..... D21/584
5,019,010 A * 5/1991 Nikaido et al. ..... 446/487
7,306,504 B2 * 12/2007 Saucier ..... 446/487

* cited by examiner

*Primary Examiner*—Robert E Pezzuto
*Assistant Examiner*—Alex F. R. P. Rada, II
(74) *Attorney, Agent, or Firm*—Rabin & Berdo, P.C.

(57) ABSTRACT

A robot-like electronic device changeable from a cubical or box profile to a robot profile includes a first body, two second bodies and a third body. The two second bodies are hinged to two sides of the first body through a swiveling beam. The third body is pivotally coupled on the bottom side of the first body. The first, second and third bodies can swivel relative to one another. The two second bodies and the third body can be coupled with the first body, to become a cubic or box. The two second bodies also may be swiveled outwards, like two arms of a robot. The third body can be swiveled 90 degrees relative to the first body and bent forwards like a foot, so that the first body can stand upright on a flat surface like a robot.

15 Claims, 8 Drawing Sheets

ROBOT-LIKE ELECTRONIC DEVICE

CROSS-REFERENCE TO RELATED APPLICATIONS

This non-provisional application claims priority under 35 U.S.C. § 119(*a*) on Patent Application No(s). 93140081 filed in Taiwan, R.O.C. on Dec. 22, 2004, the entire contents of which are hereby incorporated by reference.

BACKGROUND OF THE INVENTION

1. Field of Invention

The present invention relates to a movable mechanism for electronic devices and particularly to a robot-like electronic device, which has a plurality of bodies that are pivotally coupled and transformable to change the profile.

2. Related Art

The multi-media electronic devices now on the market mostly are formed in a fixed and static profile. Their external appearance cannot be changed. Some of the devices can present an additional visual effect when subject to varying lighting. When in use, a switch is turned on or depressed by users to activate the multi-media electronic device. There is little interaction between the users and the device.

Take multi-media video/audio players for instance. They generally are formed in a rectangular shape at a dimension according to its utilization. The portable player usually is designed with an attractive profile and has a simple display unit, which is luminous and can change color. The display unit generally includes LEDs or OLEDs to provide information of the playing files. The picture on the display unit can change to provide additional decoration. The industrial design of these players aims to facilitate carrying, storing or mounting, and generally is formed in a flattened shape without protruding features. Hence the variations of their profiles are limited. There are no movable elements to generate interaction with users or create a more amusing effect.

Recently, a rocking toy has been introduced on the market. It can sway and move in various manners. It has a sound-controlled switch to receive external sound to start swaying and moving to imitate dancing with music. Such a sound-controlled toy can be integrated with a radio player so that it can dance while receiving radio programs. But its movements are simple and limited, merely swaying about an upright direction. Moreover, its structure is not compact and difficult to carry or store. It does not live up to the prevailing 'lean ' and 'light' trend for small electronic devices.

SUMMARY OF THE INVENTION

In view of the aforesaid problems, the primary object of the present invention is to provide a robot-like electronic device that can present various profiles. It has movable elements that are foldable to form an integrated and compact profile. Hence storing or carrying is easier.

In order to achieve the foregoing object, the robot-like electronic device according to the invention has a cubic or box profile, which may be transformed to be shaped like a robot. It includes a first body to house an electronic circuit to control operation of the electronic device, two second bodies, two swiveling beams, which have one end hinged on two sides of the first body and other end pivotally coupled on the second body so that the two second bodies can be selectively moved close to the first body or moved away from the first body through swiveling of the two swiveling beams, and a third body pivotally coupled with the first body and swiveling, to form an angle or to be parallel with the first body.

By pivotally moving the two second bodies and the third body, they can be coupled with the first body to become an integrated body. The two second bodies may also be swiveled outwards to form two stretched arms. The third body can be swiveled relative to the first body for 90 degrees and bent forwards to form a foot so that the first body can stand upright on a flat surface like a robot.

Each of the pivotal coupling portions of the bodies may further include a motor and a gear set. Through driving of the motor, each body can rotate automatically. Coupled with settings of the electronic circuit, the profile can be altered in response to different trigger signals.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given in the illustration below only, and thus is not limitative of the present invention, wherein.

DETAILED DESCRIPTION OF THE INVENTION

Figure 1:
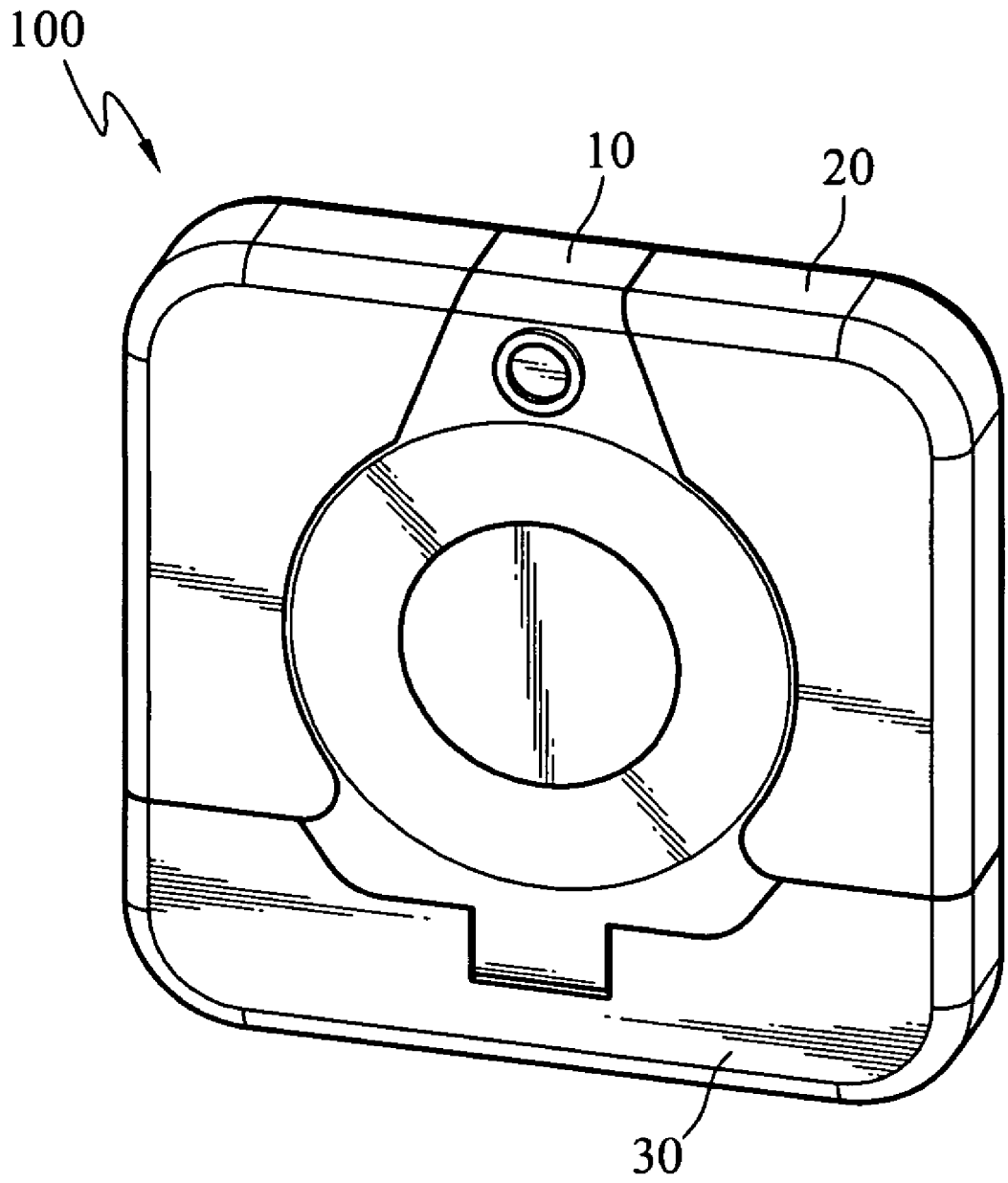
FIG. 1 is a perspective view of an embodiment of the invention.

Referring to FIG. 1, the robot-like electronic device 100 according to the invention is formed with a cubic or box profile and equipped with multi-media functions for playing video and audio such as an MP3 player, DVD player, or capturing video and audio such as a Web Cam, Microphone or the like.

The device includes a first body 10, which houses an electronic circuit (not shown in the drawing) to provide multi-media functions. The electronic circuit is known in the art, thus its details are omitted hereinafter. Different types of electronic devices have different types of electronic circuits. The device further has two second bodies 20 and a third body 30. The first body 10, second bodies 20 and third body 30 are formed with sides matting the profiles of each other and can be coupled together to become an integrated body in a cubical manner.

Figure 2:
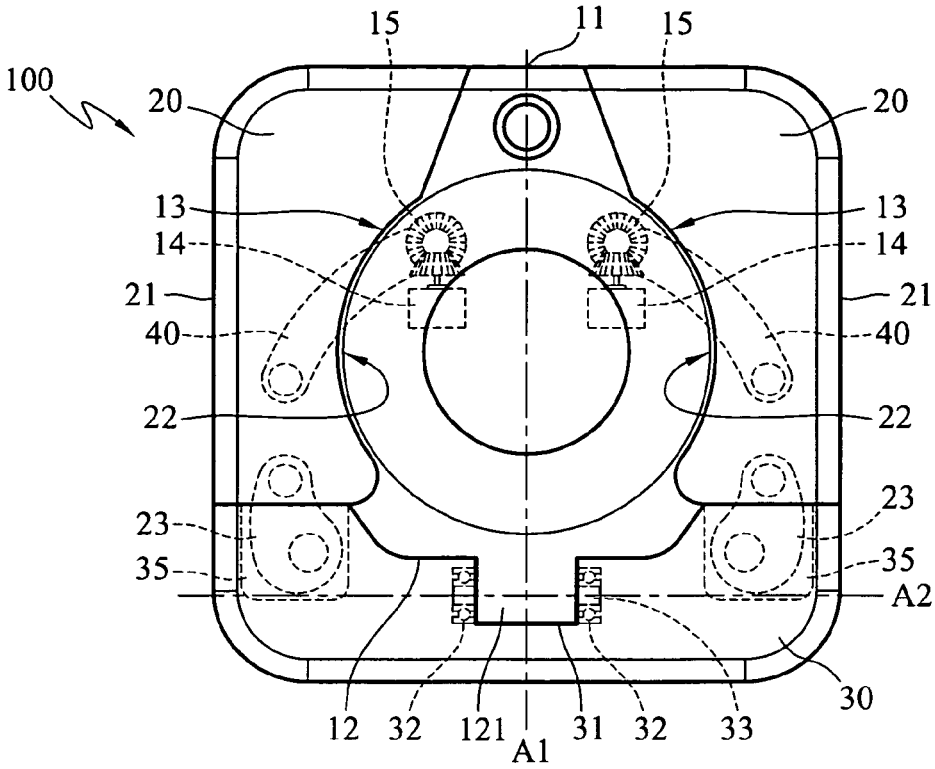
FIG. 2 is a front view of an embodiment of the invention.
Figure 3:
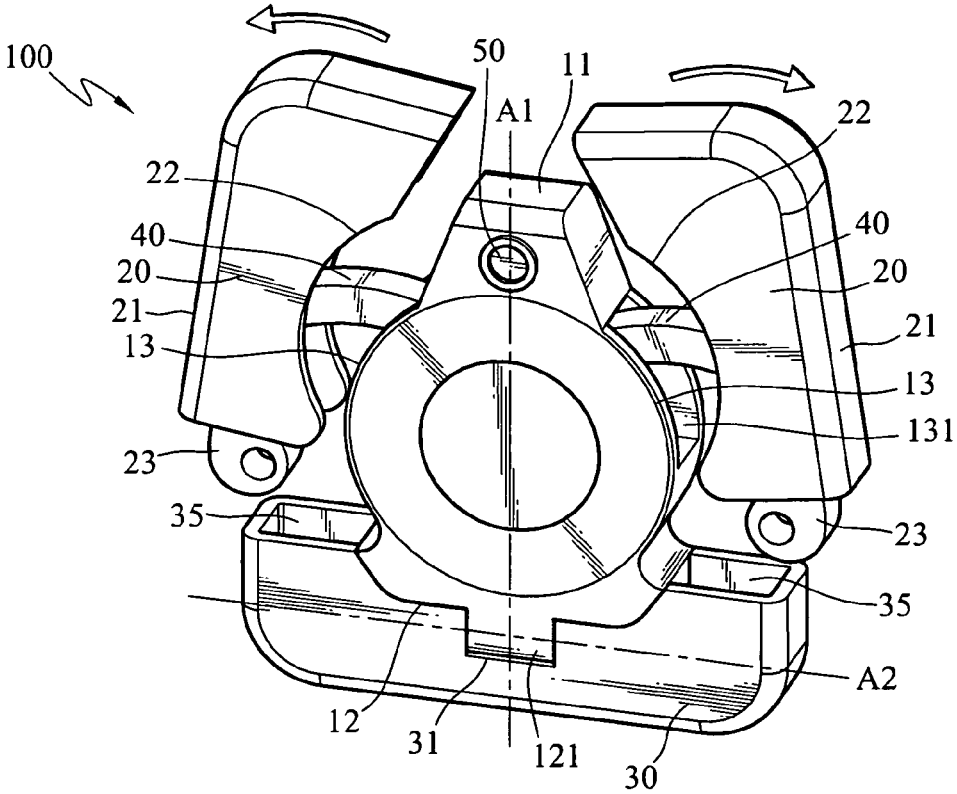
FIG. 3 is a perspective view of an embodiment of the invention transformed to another profile.
Figure 4:
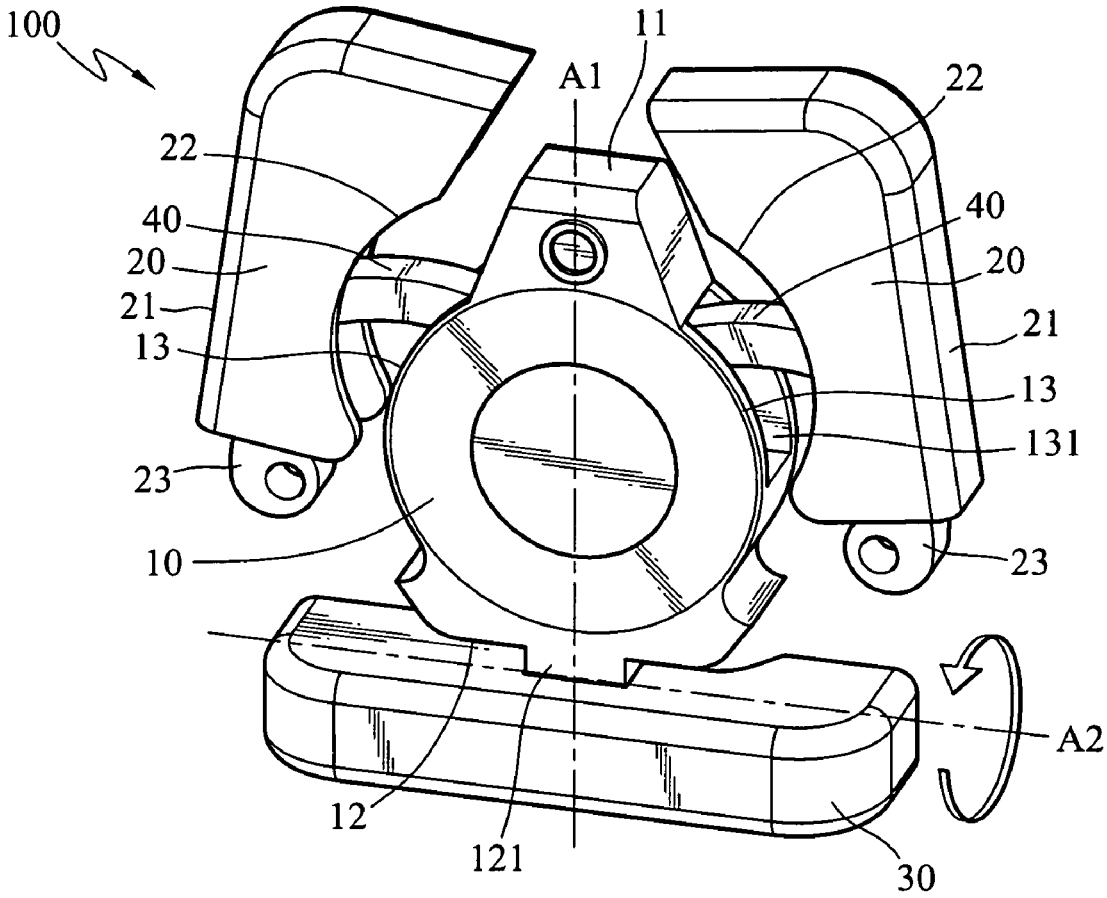
FIG. 4 is a perspective view of an embodiment of the invention transformed to yet another profile.

Referring to FIGS. 2, 3 and 4, the second bodies 20 and third body 30 are movable relative to the first body 10 to alter the external shape of the robot-like electronic device 100 to different profiles, such as a robot shown in FIG. 4.

The first body 10 is hollow for housing the electronic circuit. It has a top side 11, a bottom side 12 and two lateral sides 13. The top side 11 and the bottom side 12 are spaced to define a first axis A1. The two lateral sides are symmetrical against the first axis A1. Each of the two lateral sides 13 has a trough 131 running through the first body 10. The bottom side 12 has a pivot portion 121.

The two second bodies 20 are formed respectively in a box profile, and have an open side 22 and a closed side 21. The open side 22 has a portion of profiles mating the two lateral sides of the first body 10, so that the open side 22 can cover the two lateral sides 13 of the first body 10. The two second bodies 20 are hinged with two decorative members 23 inside that may be exposed through the open side 22, to form a palm.

There are two swiveling beams 40 to pivotally connect the first body 10 and the two second bodies 20. Each of the swiveling beams 40 has one end passing through the trough 131 and is hinged inside the first body 10. The swiveling beam 40 has another end passing through the open side 22 of the second body 20, to be hinged in the second body 20. The two second bodies 20 can be swiveled to close to the first body 10 as shown in FIG. 2, or be swiveled away from the first body 10 by swiveling the two swiveling beams 40 as shown in FIG. 3. The first body 10 further has two motors 14 inside to engage respectively with a gear set 15, to provide power to drive the two swiveling beams 40 to sway. The two gear sets 15 contain bevel gears to change the axial direction of the output torque of the two motors 14, so that the two motors 14 can output torque to a direction as desired without restriction.

The third body 30 has an indented pivot seat 31 in the middle portion of one side. The pivot seat 31 has two ends located inside the third body 30 to hold respectively a bearing 32. The third body 30 is coupled with the pivot portion 121 of the first body 10 through the pivot seat 31. An axle 33 runs through the pivot portion 121 and the two bearings 32. The axial direction of the axle 33 is defined as a second axis A2, which is parallel with the electronic device 10 and perpendicular to the first axis Al. The third body 30 can rotate about the second axis A2 relative to the first body 10 and form an angle with the first body 10. Therefore, the first body 10 can stand upright with the third body 30, serving as a base or a foot as shown in FIG. 4. The third body 30 and the first body 10 can also be coupled together to become an integrated, body as shown in FIG. 3. The third body 30 may further have two housing portions 35 on one side, abutting the first body 10. Thus when the second bodies 20 are moved close to the first body 10, the decorative members 23 that are exposed outside the second bodies 20 can be held in the housing portions 35. A portion of the open side 22 of the second body 20 that is not coupled with the first body 10 can be coupled with the third body 30.

The robot-like electronic device 100 of the invention may be changed to different profiles according to user requirements. For storing or carrying, the first body 10, second bodies 20 and third body 30 may be swiveled to become a cubical profile without a protruding structure to facilitate carrying or storing. At such a profile, it can function or rest on a flat surface. By swiveling the third body 30 about the second axis A2 relative to the first body 10 to form an angle, the third body 30 can rest on a desktop while the first body 10 can stand upright, and the two second bodies 20 can be swiveled away from the first body 10 through the two swiveling beams 40. The two swiveling beams 40 can sway as desired. The two motors 14 can operate according to functional settings of the electronic device 100 to drive the two swiveling beams 40, to sway and drive the two second bodies 20, to sway like swinging arms. Thereby, the profile of the invention can move like a robot.

Figure 5:
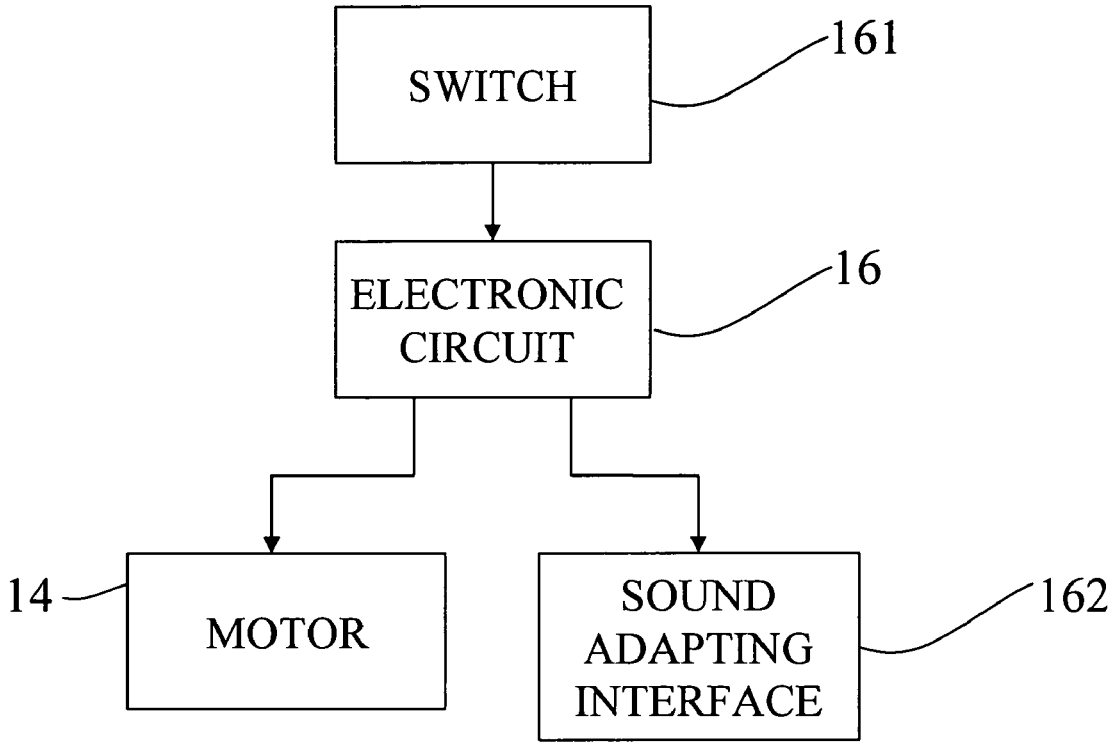
FIG. 5 is a control block diagram of an embodiment of the invention.
Figure 6:
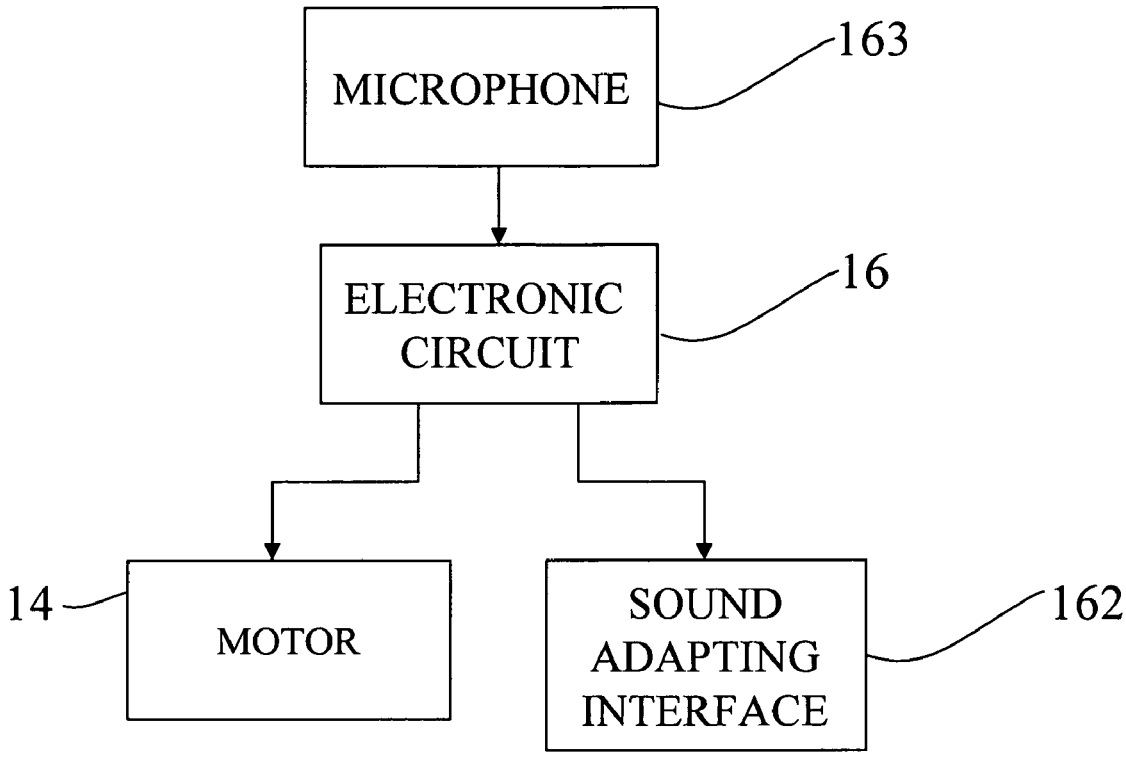
FIG. 6 is a control block diagram of an embodiment of the invention for another application.

Referring to FIGS. 5 through 8, the two motors 14 can be activated by music when the invention functions as a video/audio player. As shown in FIG. 5, a switch 161 is provided to activate the electronic circuit 16 located in the robot-like electronic device 100. Variations of rhythm or beat can activated the electronic circuit 16 to output different current to the two motors 14 and a sound signal to a sound adapting interface 162 to drive the two second bodies 20, to move in different or corresponding patterns. The swaying of the second bodies 20 varies according to the sound volume of the music to create an amusing effect. A microphone 163 may also be included to receive external sound. The sound volume can activated the electronic circuit 16 to output different current to control operation of the two motors 14, and alter the sound signal output to the sound adapter card 162 to drive the robot-like electronic device 100, to move according to the external sound as shown in FIG. 6.

Figure 7:
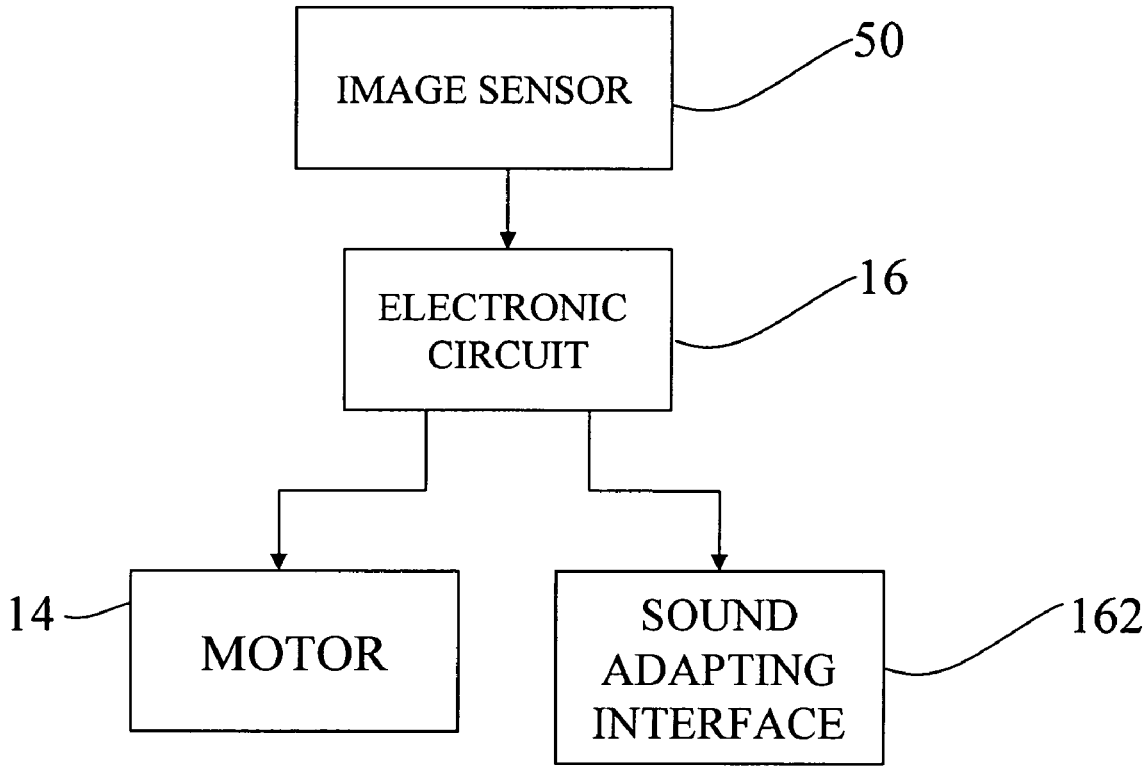
FIG. 7 is a control block diagram of an embodiment of the invention for yet another application.

The first body 10 may also include an image sensor 50, such as a CCD or CMOS detection element. Through program setting of the robot-like electronic device 100, the image sensor 50 can capture selected people or colors, to trigger activation, so that when the captured data matches the built-in data, the motors 14 are activated as shown in FIG. 7.

Figure 8:
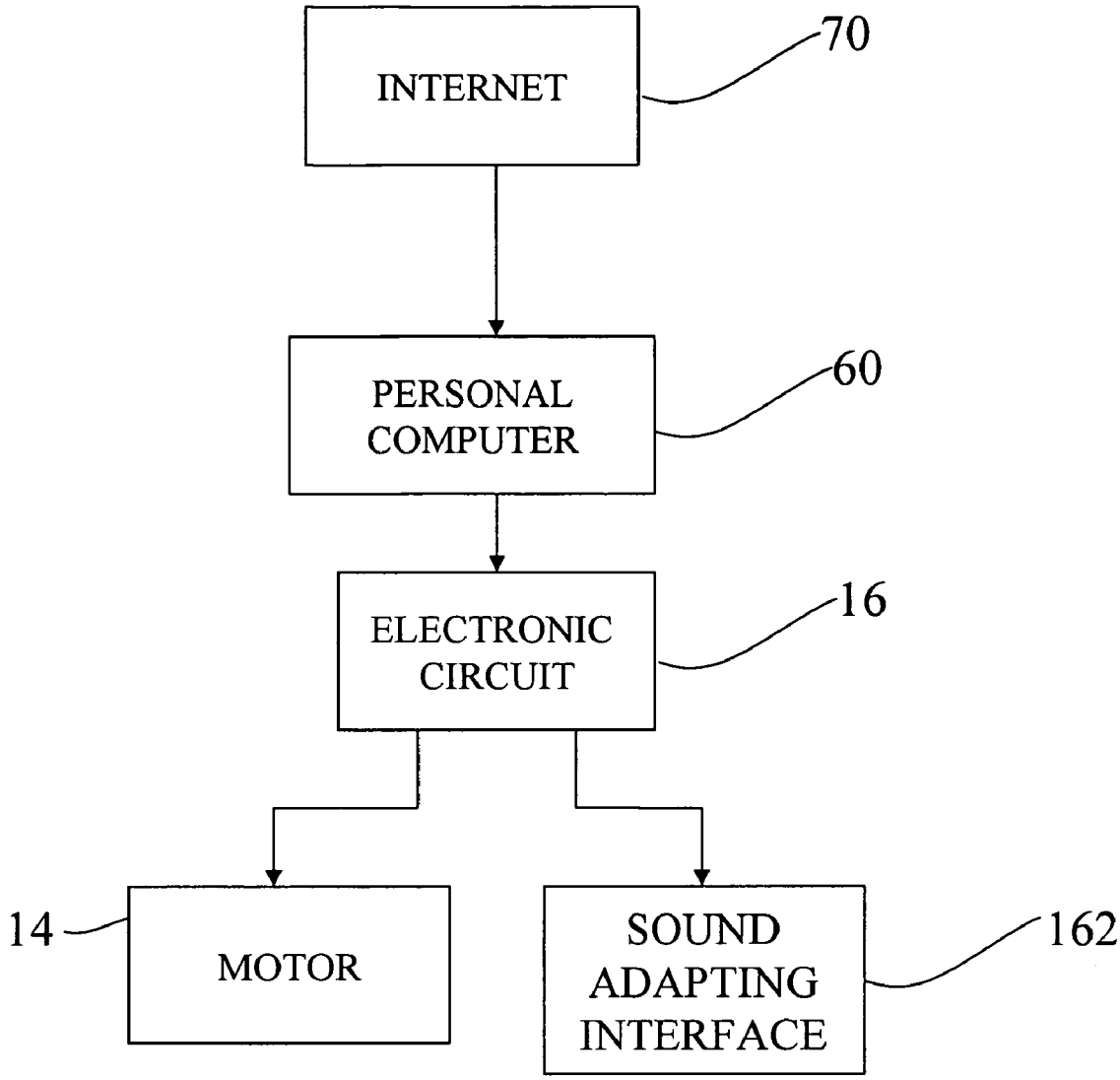
FIG. 8 is a control block diagram of an embodiment of the invention for still another application.

In addition, the invention may also be activated by a trigger signal through a personal computer 60 and linking of the Internet 70. For instance, through E-mail or an instant message software, designated contact people may be set to activate operation of the robot-like electronic device 100 through the electronic circuit 16, and sound may be generated through the sound adapting interface 162, and the two motors 14 may be actuated to drive the second bodies 20 to perform corresponding movements as shown in FIG. 8.

Figure 9:
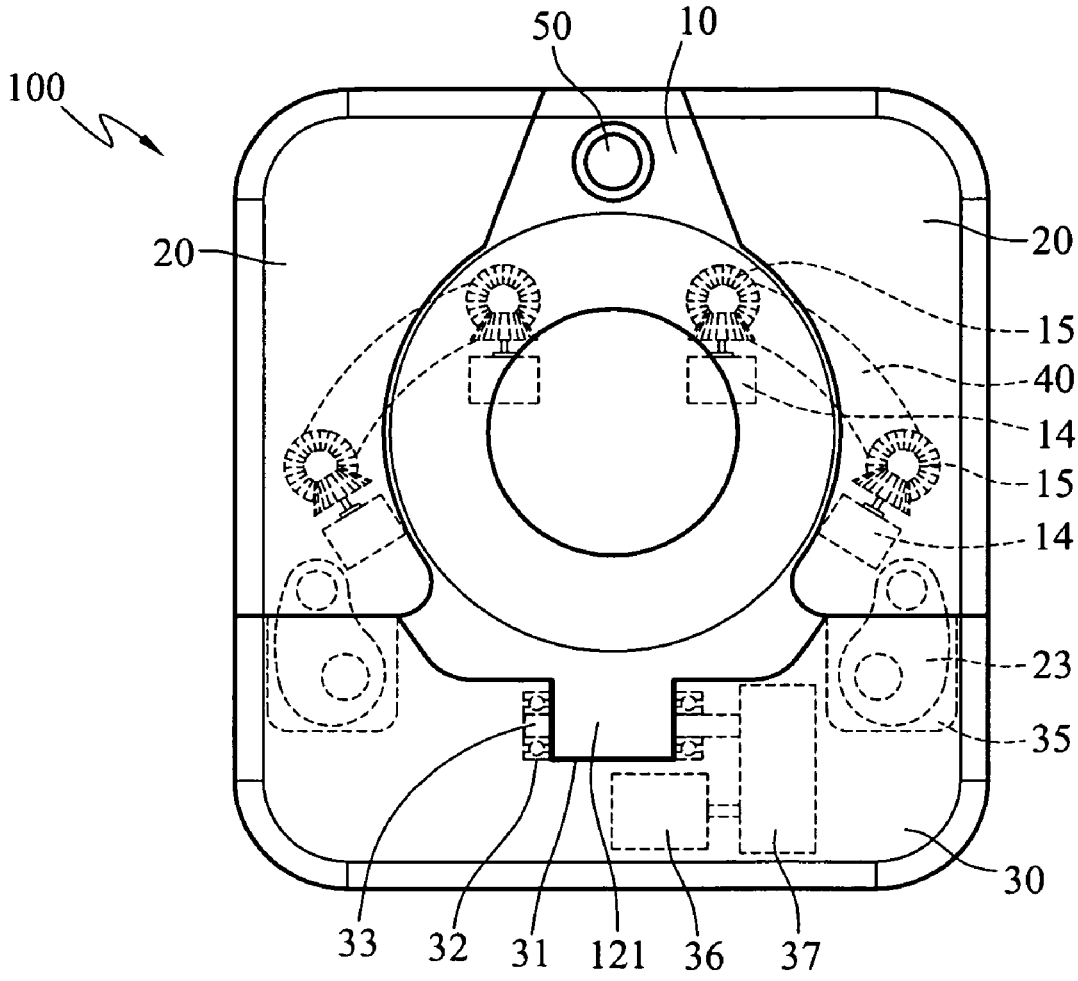
FIG. 9 is a front view of another embodiment of the invention.

The robot-like electronic device 100 according to the invention, aside from providing the original multi-media functions, also can couple the multi-media functions with profile transformation to generate an interactive effect. The driving source of the moving effect can be added according to different requirements. Referring to FIG. 9, the motor 14 and gear set may also be installed respectively on the hinged locations of the second bodies 20 and the swiveling beams 40 so that the two second bodies 20 can swivel automatically relative to the two swiveling beams 40. To further increase change patterns, the third body 30 may have another motor 36. Through a transmission set 37, the torque and direction of the driving output of the motor 36 can be changed. The transmission set 37 is coupled with another axle 33, to drive the first body 10 to rotate relative to the third body 30 so that the first body 10 can stand upright automatically without maneuvering of an external force.

Knowing the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A robot-like electronic device, comprising:

a first body, the first body being hollow for containing an electronic circuit, the first body including two motors and two gear sets disposed therein, and further having two troughs running therethrough;

two second bodies;

two swiveling beams each having one end running through a respective trough to be hinged with a respective motor through a respective gear set and another end pivotally coupled with a respective second body, wherein the respective motors provide driving power to swivel the two second bodies close to the first body or away from the first body through swiveling of the two swiveling beams;

and a third body pivotally coupled on the first body.

2. The robot-like electronic device of claim 1, wherein the first body, the second bodies and the third body have sides matching to the profiles of each other, to be coupled together to become an integrated cubic body.

3. The robot-like electronic device of claim 1, wherein the electronic circuit includes a microphone to receive external sounds, the electronic circuit outputting different currents according to sound volume to control an operation of the two motors.

4. The robot-like electronic device of claim 1, wherein the first body has an image sensor to activate the electronic circuit to activate the operation of the two motors.

5. The robot-like electronic device of claim 1, wherein the two second bodies are formed in a box profile which has an open side, each of the swiveling beams having an end running through the open side to be pivotally coupled with the second body.

6. The robot-like electronic device of claim 5, wherein the two second bodies are pivotally coupled with two decorative members which are exposed through the open side.

7. The robot-like electronic device of claim 5, wherein each of the two second bodies has a motor to engage with one of the two swiveling beams through a gear set to provide driving power to swivel the second bodies against the swiveling beams.

8. The robot-like electronic device of claim 1, wherein each first body has a pivot portion on one side, the third body having an indented pivot seat in a middle portion of one side thereof to couple with the pivot portion of the first body.

9. The robot-like electronic device of claim 8, wherein the pivot seat has two ends located in the third body and containing respectively a bearing, and an axle running through the pivot portion and the bearings.

10. The robot-like electronic device of claim 9, wherein the third body includes a third motor and a transmission case which changes torque and output driving direction of the third motor, the axle being coupled with the transmission case to drive the first body to rotate relative to the third body.

11. The robot-like electronic device of claim 1, wherein the electronic circuit is connected to a personal computer which is linked to the Internet.

12. A robot-like electronic device, comprising:

a first body, containing an electronic circuit;

two second bodies, each second bodies being formed in a box profile which has an open side, wherein each of the two second bodies has a motor and a gear set disposed therein;

two swiveling beams, each having one end hinged on the first body and another end running through a respective open side to be pivotally coupled with a respective motor through a respective gear set, wherein the motors provide driving power to swivel the two second bodies close to the first body or away from the first body through swiveling of the two swiveling beams; and a third body pivotally coupled on the first body.

13. The robot-like electronic device of claim 12, wherein the two second bodies are pivotally coupled with two decorative members which are exposed through the open side.

14. A robot-like electronic device, comprising:

a first body containing an electronic circuit, the first body having a pivot portion on one side thereof;

two second bodies;

two swiveling beams, each having one end hinged on the first body and another end pivotally coupled with a respective second body, the two second bodies being swiveled to close to the first body or being swiveled away from the first body through swiveling of the two swiveling beams; and a third body pivotally coupled on the first body, the third body having an indented pivot seat in a middle portion of one side thereof that couples with the pivot portion of the first body, wherein the pivot seat has two ends located in the third body, each end containing respectively a bearing, and an axle running through the pivot portion and the bearings.

15. The robot-like electronic device of claim 14, wherein the third body includes a third motor and a transmission case which changes torque and output driving direction of the third motor, the axle being coupled with the transmission case to drive the first body to rotate relative to the third body.

* * * * *